US006667722B1

(12) United States Patent
Schmidt et al.

(10) Patent No.: US 6,667,722 B1
(45) Date of Patent: Dec. 23, 2003

(54) MULTIBEAM RADAR SENSOR WITH A FIXING DEVICE FOR A POLYROD

(75) Inventors: Ewald Schmidt, Ludwigsburg (DE); Hermann Mayer, Vaihingen (DE); Bernhard Lucas, Besigheim (DE); Thomas Beez, Weinsberg (DE); Joachim Hauk, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/830,134

(22) PCT Filed: Jul. 21, 2000

(86) PCT No.: PCT/DE00/02372

§ 371 (c)(1),
(2), (4) Date: Jul. 20, 2001

(87) PCT Pub. No.: WO01/15273

PCT Pub. Date: Mar. 1, 2001

(30) Foreign Application Priority Data

Aug. 21, 1999 (DE) ..... 199 39 832

(51) Int. Cl.[7] ..... H01Q 13/00
(52) U.S. Cl. ..... 343/785; 343/878
(58) Field of Search ..... 343/700 MS, 785, 343/786, 878

(56) References Cited

U.S. PATENT DOCUMENTS

| | | | | | |
|---|---|---|---|---|---|
| 4,633,262 | A | * | 12/1986 | Traut | 343/700 MS |
| 4,697,189 | A | * | 9/1987 | Ness | 343/700 MS |
| 5,627,551 | A | * | 5/1997 | Tsuru et al. | 343/700 MS |
| 5,757,323 | A | * | 5/1998 | Spencer | 343/700 MS |
| 6,147,647 | A | * | 11/2000 | Tassoudji et al. | 333/219.1 |
| 6,154,175 | A | * | 11/2000 | Yee | 343/700 MS |

FOREIGN PATENT DOCUMENTS

| | | |
|---|---|---|
| DE | 197 10 811 | 9/1998 |
| DE | 198 59 002 | 6/2000 |
| WO | WO 97 02496 | 1/1997 |

* cited by examiner

*Primary Examiner*—Tan Ho
(74) *Attorney, Agent, or Firm*—Kenyon & Kenyon

(57) ABSTRACT

A multibeam radar sensor is proposed in which a holder (of resilient construction) for polyrods, in connection with a spacing element, holds the polyrods fixedly at a predetermined spacing, preferably in the range between 0 mm and 0.2 mm. The stays of the holder are fashioned such that a spring force constantly presses the spacing element against the base plate. In this context, the spring force is chosen such that the maintenance of the predetermined spacing a is ensured even under disadvantageous operating conditions such as vibration, shock, and impact.

10 Claims, 1 Drawing Sheet

MULTIBEAM RADAR SENSOR WITH A FIXING DEVICE FOR A POLYROD

FIELD OF THE INVENTION

The present invention relates to a multibeam radar sensor having a holder for a polyrod (pre-focusing element, also called a rod radiator).

BACKGROUND INFORMATION

Radar sensors in which polyrods are used for pre-focusing are known for example from PCT Publication No. 97/02496. Here a vehicular FMCW radar sensor for detecting objects is proposed, in which for example three transceive elements are attached to a lateral structure of a microwave strip conductor. In the beam path, a dielectric rod radiator (polyrod) is additionally attached before each antenna element, in order to achieve a better illumination of the dielectric lens and thus a pre-focusing. However, it has turned out that problem-free functioning of the rod radiator is ensured only if this radiator is positioned precisely. Even small deviations from the ideal position result in an over-radiation of the lens, or a coupling with adjacent polyrods.

German Published Patent Application No. 197 10 811, describes a device for the directed radiation and/or reception of electromagnetic waves. This device is made up of at least one antenna element, a dielectric lens, and a dielectric element (polyrod) that is situated between the antenna element and the dielectric lens. This dielectric element is used to avoid overradiation of the dielectric lens and to pre-focus the electromagnetic waves radiated or received by the antenna element. For the simplification of the required exact adjustment, the dielectric element is extended in surface and is preferably fashioned in the shape of a pot. In this case as well, an insufficient decoupling of the electromagnetic waves is to be assumed, since the same dielectric element is used for all antenna elements.

SUMMARY OF THE INVENTION

A multibeam radar sensor is proposed in which a holder (of resilient construction) for polyrods, in connection with a spacing element, holds the polyrods fixedly at a predetermined spacing, preferably in the range between 0 mm and 0.2 mm. The stays of the holder are fashioned such that a spring force constantly presses the spacing element against the base plate. In this context, the spring force is chosen such that the maintenance of the predetermined spacing a is ensured even under disadvantageous operating conditions such as vibration, shock, and impact.

DETAILED DESCRIPTION

Figure 1:
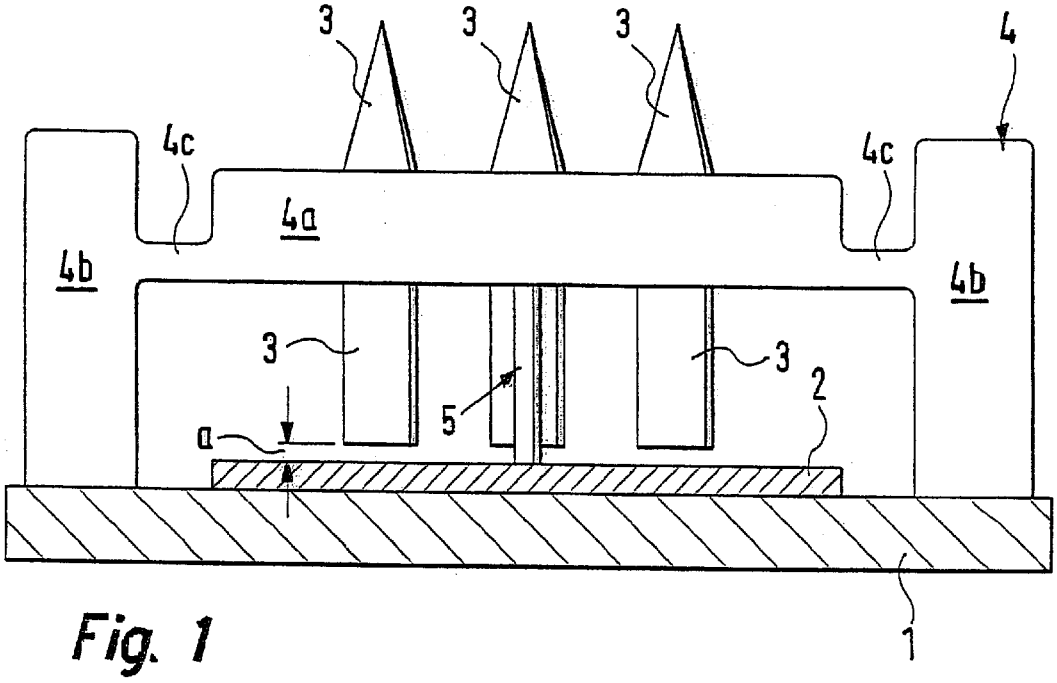
FIG. 1 shows a cross-section of a spacing element for a polyrod.

FIG. 1 contains, for reasons of clarity, only the elements representing an inventive holder 4 for polyrods 3. The additional elements of the radar sensor are sufficiently known and need not be explained in more detail.

As is shown in the cross-sectional drawing of FIG. 1, a microwave conductor structure 2, over which three approximately cone-shaped polyrods 3 are situated, is shown on a base plate 1. In this context, holder 4 is fashioned such that polyrods 3, which are connected fixedly with a bridge part 4*a* of holder 4, are situated precisely over the transceive elements of microwave conductor structure 2 (not shown in FIG. 1). According to the present invention, it is provided to fix spacing a, between the surface of microwave conductor structure 2 and the underside of polyrods 3, in a range between 0 mm and 0.2 mm. A modification of spacing a, even outside the predetermined range, can likewise be carried out in individual cases.

In order to maintain spacing a, a spacing element 5 is provided that is situated at a suitable point on the underside of bridge part 4*a*. Since polyrods 3 are connected fixedly with bridge part 4*a*, and in addition bridge part 4*a* is of relatively massive construction in order to prevent a mutual relative motion of polyrods 3, resilient regions 4*c* are provided between stays 4*b* and bridge part 4*a*. In relation to base plate 1, stays 4*b* are dimensioned in their length such that spacing element 5 is for example pressed against the base plate via spring-loaded regions 4*c* and bridge part 44*a*. In this context, the pressure is dimensioned such that the precise maintenance of spacing a is ensured even under disadvantageous operating conditions such as vibration, shock, or impact.

Figure 2:
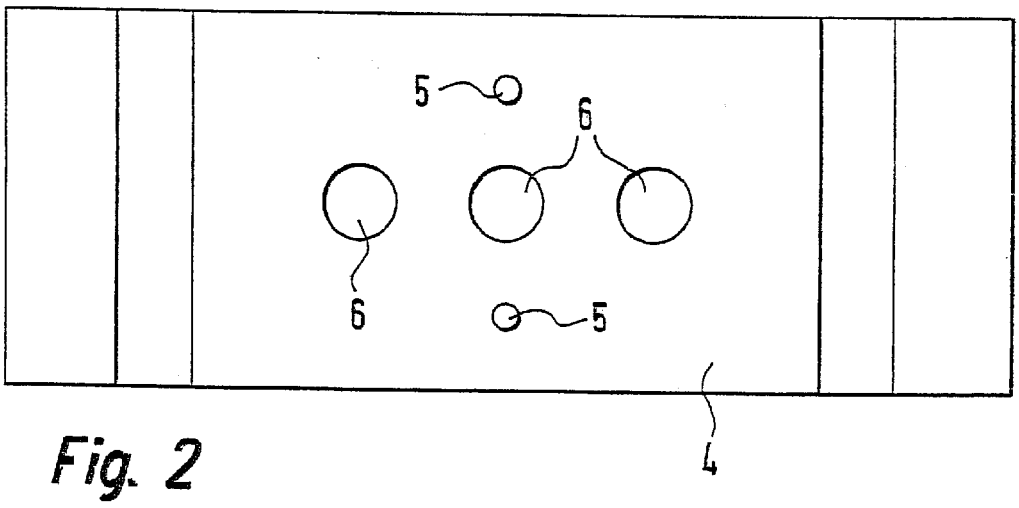
FIG. 2 shows a view from below according to the present invention

A further improvement of the subject matter of the present invention provides that one or more additional spacing elements 5 can be provided at suitable points such as can be learned from FIG. 2.

It is provided to insert spacing element 5 into the design either through placement of a suitable material. Alternatively, spacing element 5 can be stamped, or, given the use of plastics, can be stamped in a casting, extrusion, or pressing method. A dielectric material, which in relation to the material of polyrods 3 promotes a reduction of the mutual coupling with adjacent polyrods 3, is preferably used for holder 4.

FIG. 2 shows a view from below. As can be learned from the drawing, polyrods 3 are guided through bored holes 6 that are arranged in a row. Two spacing elements 5 of cylindrical construction are arranged so as to be rotated in relation thereto, preferably by 90°. The shape of spacing elements 5 can be selected arbitrarily under the given boundary conditions. For example, they can also be fashioned annularly around polyrods 3.

What is claimed is:

1. A multibeam radar sensor, comprising:

a microwave conductor structure;

at least one polyrod situated over suitable points of the microwave conductor structure in order to achieve a pre-focusing of microwaves; and a holder for fixing the at least one polyrod, the holder including:

at least one resilient region, and a spacing element through which the holder fixes a spacing of the at least one polyrod from the microwave conductor structure.

2. The radar sensor according to claim 1, wherein:

the holder includes an opening in order to achieve a fixing reception of the at least one polyrod.

3. The radar sensor according to claim 1, wherein:

the spacing element is situated on an inside of the holder.

4. The radar sensor according to claim 3, wherein:

the spacing element is arranged as a fixed part of the holder.

5. The radar sensor according to claim 1, wherein:

the holder includes an additional spacing element arranged thereon.

6. The radar sensor according to claim 1, wherein:

the holder is arranged with a predetermined spring force.

7. The radar sensor according to claim 6, wherein:

the spring force is such that the at least one polyrod does not alter a predetermined spacing under stress from one of a shock, an impact, and a vibration.

8. The radar sensor according to claim 1, wherein:

the holder fixes the spacing of the at least one polyrod from the microwave conductor structure in a range between 0 mm and 0.2 mm.

9. A spacing element for a radar sensor, comprising:

a structure including an essentially non-elastic structure, wherein:

the structure is fixedly situated on an underside of a holder having at least one resilient region.

10. A spacing element for a radar sensor, comprising:

a structure including an essentially non-elastic structure, wherein:

the structure is fixedly situated on an underside of a holder, and wherein the spacing element fixes a spacing between at least one polyrod and a microwave conductor structure.

* * * * *